US010384478B2

(12) United States Patent
Opfer et al.

(10) Patent No.: US 10,384,478 B2
(45) Date of Patent: Aug. 20, 2019

(54) MEDIA CUTTING APPARATUS

(71) Applicant: HEWLETT-PACKARD INDIGO B.V., Amstelveen (NL)

(72) Inventors: Shamai Opfer, Mazkeret Batya (IL); Itzik Kent, Ness Ziona (IL); Ilan Meiri, Yavne (IL)

(73) Assignee: HP Indigo B.V., Amstelveen (NL)

( * ) Notice: Subject to any disclaimer, the term of this patent is extended or adjusted under 35 U.S.C. 154(b) by 397 days.

(21) Appl. No.: 14/433,849

(22) PCT Filed: Oct. 29, 2012

(86) PCT No.: PCT/EP2012/071409

§ 371 (c)(1),
(2) Date: Apr. 6, 2015

(87) PCT Pub. No.: WO2014/067555

PCT Pub. Date: May 8, 2014

(65) Prior Publication Data

US 2015/0251458 A1 Sep. 10, 2015

(51) Int. Cl.

| | |
|---|---|
| ***B41J 11/70*** | (2006.01) |
| ***B41F 13/60*** | (2006.01) |
| ***B41F 19/00*** | (2006.01) |

(52) U.S. Cl.

CPC ..... *B41J 11/70* (2013.01); *B41F 13/60* (2013.01); *B41F 19/008* (2013.01); *Y10T 83/0505* (2015.04); *Y10T 83/6476* (2015.04)

(58) Field of Classification Search

CPC ..... B41J 11/66–11/70; B41J 11/703; B41J 11/706; B41F 13/54–62; B41F 19/008; Y10T 83/0505; Y10T 83/0515; Y10T 83/051; Y10T 83/0524; Y10T 83/0548; Y10T 83/0553; Y10T 83/0562; Y10T 83/0572; Y10T 83/6476; Y10T 83/647; Y10T 83/6478; Y10T 83/6497;

(Continued)

(56) References Cited

U.S. PATENT DOCUMENTS 5,439,208 A * 8/1995 Moser ..... B65H 15/00 271/182
5,609,084 A * 3/1997 Gronbjerg ..... B26D 1/385 83/100

(Continued)

FOREIGN PATENT DOCUMENTS

| | | |
|---|---|---|
| EP | 1308779 A2 | 5/2003 |
| GB | 2272402 A | 5/1994 |

OTHER PUBLICATIONS

How to Fix Paper Jam Error Samsung ML-4551; printed from website on Apr. 5, 2018; http://forum.testcopy.net/threads/how-to-fix-paper-jam-error-samsung-ml-4551.1830/.

(Continued)

*Primary Examiner* — Phong H Nguyen
(74) *Attorney, Agent, or Firm* — HP Inc. Patent Department

(57) ABSTRACT

Media cutting apparatus including a cutter arrangement to cut media along a line perpendicular to the direction of movement of the media, and a first roller to rotate media cut by the cutter arrangement to change the orientation of a longitudinal axis of the media. The cutter arrangement is arranged to cut the media prior to and after rotation by the first roller.

14 Claims, 7 Drawing Sheets

(58) Field of Classification Search
CPC ..... Y10T 83/6584; Y10T 83/664; Y10T 83/6641; Y10T 83/04; Y10T 83/0605; Y10T 83/4539; Y10T 83/4577; Y10T 83/4579; Y10T 83/7809; Y10T 83/788; Y10T 83/808; Y10T 83/9309; Y10T 83/9396; Y10T 83/9401; Y10T 83/9399
See application file for complete search history.

(56) References Cited

U.S. PATENT DOCUMENTS

| | | | | |
|---|---|---|---|---|
| 5,931,462 | A * | 8/1999 | Delfosse | B65H 9/002 271/184 |
| 2002/0171726 | A1 | 11/2002 | Ishii et al. | |
| 2004/0237739 | A1 * | 12/2004 | Sussmeier | B26D 9/00 83/29 |
| 2010/0288145 | A1 * | 11/2010 | St. Ours | B41F 13/54 101/227 |
| 2011/0262153 | A1 | 10/2011 | Kurasawa | |
| 2012/0251212 | A1 * | 10/2012 | Hasegawa | B65H 5/062 399/381 |

OTHER PUBLICATIONS

The Benefits of Automatic Duplexing; Federal Electronics Challenge; Sep. 12, 2013; https://www.epa.gov/sites/production/files/2013-09/documents/fec_automatic_duplexing.pdf.
What Does Duplex Printing Mean? Best Printers that Print Double Sided; printed from website on Apr. 5, 2018; http://www.inkpal.com/ink-news/what-does-duplex-printing-mean/.

* cited by examiner

MEDIA CUTTING APPARATUS

BACKGROUND

Printing systems may include media cutting apparatus for cutting media to a desired size and shape. For example, a printing system may include a printing press and a media cutting apparatus and be arranged to print text and/or graphics of a publication (such as a book or a magazine) on a web or sheet of media. The media cutting apparatus may be arranged to cut the web or sheet of media to form the pages of the publication.

BRIEF DESCRIPTION

Reference will now be made by way of example only to the accompanying drawings in which.

DETAILED DESCRIPTION

Figure 1:
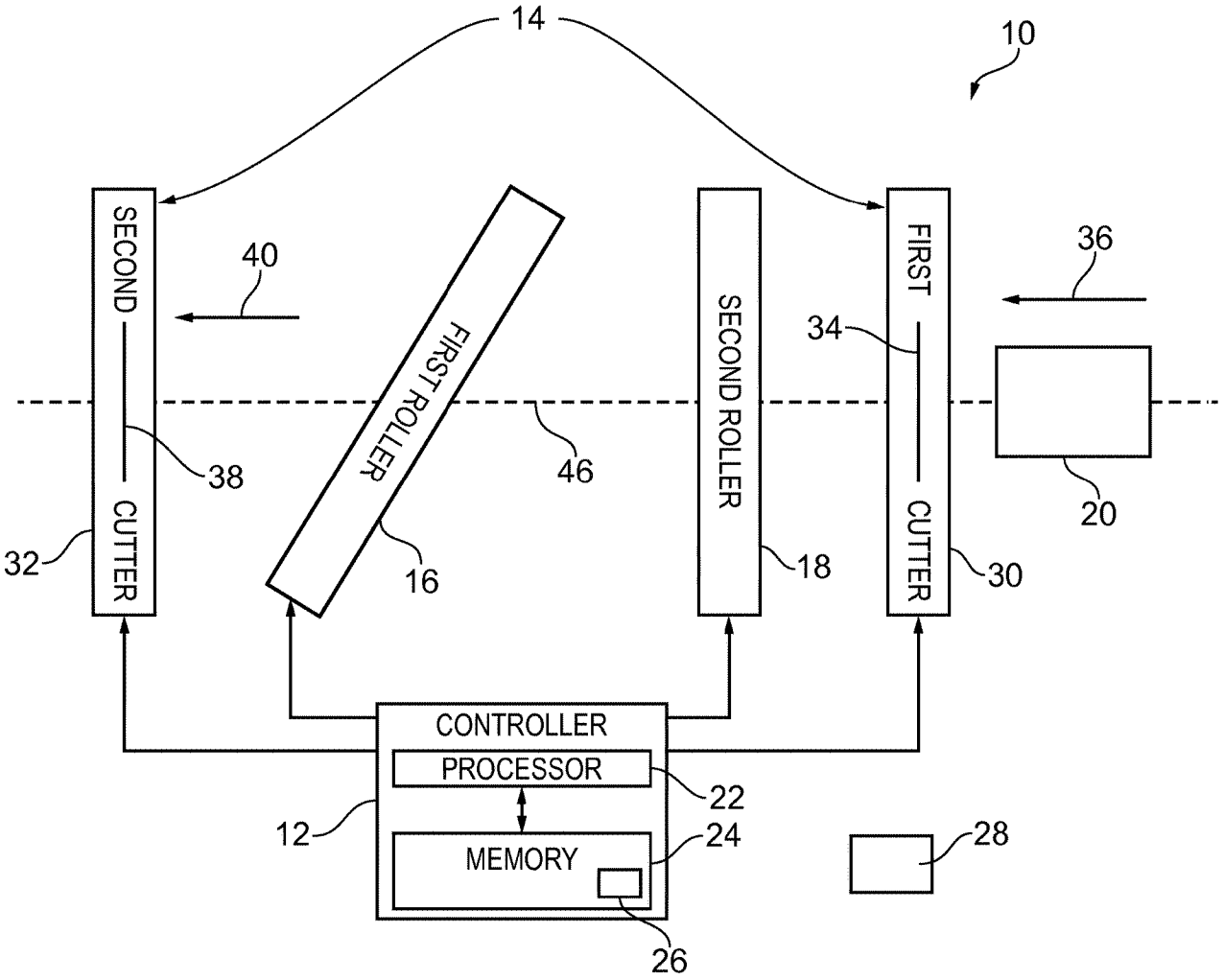
FIG. 1 illustrates a schematic plan view diagram of a media cutting apparatus according to an example.

FIG. 1 illustrates a media cutting apparatus 10 that includes a controller 12, a cutter arrangement 14, a first roller 16 and a second roller 18. The media cutting apparatus 10 is arranged to receive media 20 having a first size (A3 for example) and to cut the media 20 so that the media output by the media cutting apparatus 10 has a second size (A5 for example) which is smaller than the first size.

The implementation of the controller 12 can be in hardware alone (for example, a circuit, a processor and so on), have certain aspects in software including firmware alone or can be a combination of hardware and software (including firmware).

The controller 12 may be implemented using instructions that enable hardware functionality, for example, by using executable computer program instructions in a general-purpose or special-purpose processor 22 that may be stored on a computer readable storage medium 24 (disk, memory etc) to be executed by such a processor 22.

The processor 22 is configured to read from and write to the memory 24. The processor 22 may also comprise an output interface via which data and/or commands are output by the processor 22 and an input interface via which data and/or commands are input to the processor 22.

The memory 24 stores a computer program 26 comprising computer program instructions that control the operation of the apparatus 10 when loaded into the processor 22. The computer program instructions 26 provide the logic and routines that enables the apparatus 10 to perform the methods illustrated in FIG. 3 and described in the following paragraphs. The processor 22 by reading the memory 24 is able to load and execute the computer program 26.

The computer program may arrive at the apparatus 10 via any suitable delivery mechanism 28. The delivery mechanism 28 may be, for example, a non-transitory computer-readable storage medium, a computer program product, a memory device, a record medium such as a compact disc read-only memory (CD-ROM) or digital versatile disc (DVD), an article of manufacture that tangibly embodies the computer program 26. The delivery mechanism 28 may be a signal configured to reliably transfer the computer program 26. The apparatus 10 may propagate or transmit the computer program 26 as a computer data signal.

Although the memory 24 is illustrated as a single component it may be implemented as one or more separate components some or all of which may be integrated/removable and/or may provide permanent/semi-permanent/dynamic/cached storage.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used in this application, the term 'circuitry' refers to all of the following:

(a) hardware-only circuit implementations (such as implementations in only analogue and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware.

The cutter arrangement 14 includes a first cutter 30 and a second cutter 32 which are spaced apart from one another. The first cutter 30 and the second cutter 32 may include any suitable cutters for cross cutting the media 20. The term 'cross cutting' refers to where media is cut substantially perpendicular to the direction of movement of the media. In more detail, the first cutter 30 is arranged to cut the media 20 along a first line 34 that is perpendicular to the direction of movement 36 of the media 20 through the first cutter 30. The second cutter 32 is arranged to cut the media 20 along a second line 38 that is perpendicular to the direction of movement 40 of the media 20 through the second cutter 32. The first line 34 and the second line 38 are parallel to one another.

Figure 2:
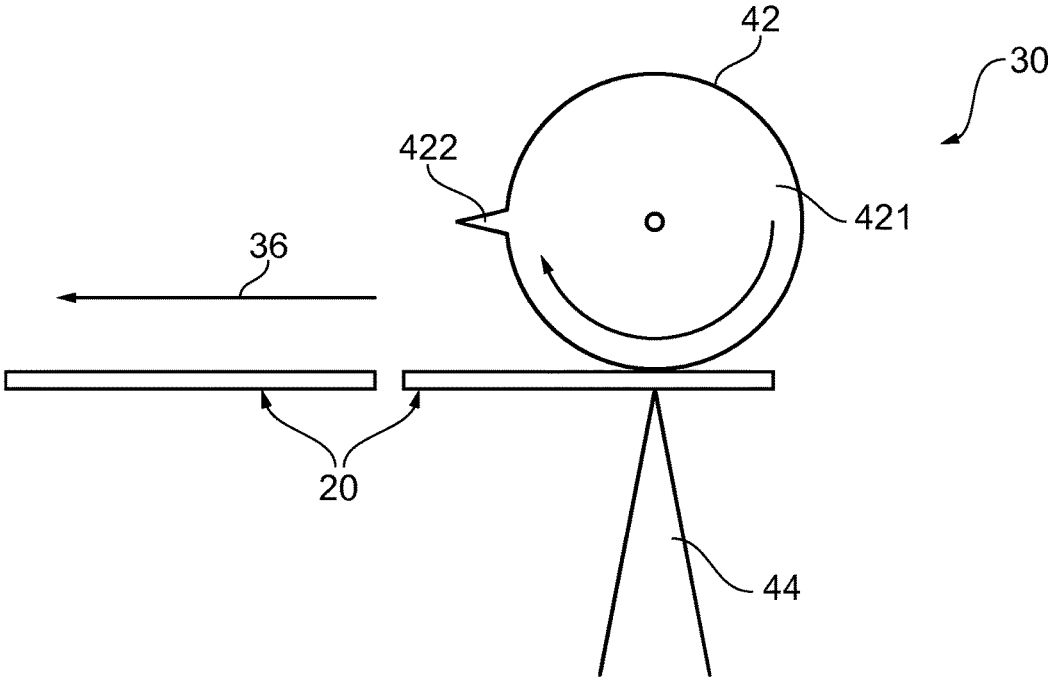
FIG. 2 illustrates a side view diagram of a cutting arrangement of a media cutting apparatus according to an example.

FIG. 2 illustrates a side view diagram of the first cutter 30 according to an example. The second cutter 32 may also have the structure illustrated in FIG. 2 and function as described below.

The first cutter 30 includes a rotary blade 42 and a static blade 44. The rotary blade 42 includes a rotatable roller 421 and a straight flat blade 422 attached to the rotatable roller 421 at an inclined angle. The blade 422 extends along at least a part of the longitudinal length of the rotatable roller 421 and is inclined relative to the longitudinal axis of the rotatable roller 421. The rotary blade 42 is positioned above the static blade 44 and the media cutting apparatus 10 is arranged to feed media 20 through the gap between the rotary blade 42 and the static blade 44.

The static blade 44 is aligned so that it is perpendicular to the direction of movement 36 of the media 20 through the first cutter 30 in order to create a square cut. Due to the inclination of the blade 422 relative to the rotatable roller 421, the rotary blade 42 has a single point of contact with the static blade 44 that advances from one side of the static blade 44 to the other as the rotary blade 42 rotates.

Returning to FIG. 1, the first roller 16 is positioned between the first cutter 30 and the second cutter 32 along an axis 46 of the media cutting apparatus 10. The first roller 16 is arranged to receive the media 20 from the first cutter 30 and to change the orientation of the media 20 (as described in greater detail in the following paragraphs). In this example, the first roller 16 is inclined at an angle of forty five degrees to the direction of movement 36 of the media 20. The first roller 16 may comprise any suitable materials and may comprise rubber for example.

The second roller 18 is positioned between the first roller 16 and the first cutter 30. The second roller 18 is arranged to receive the media 20 from the first roller 16, invert the media 20, and provide the media 20 to the second cutter 32. The second roller 18 may comprise any suitable materials and may comprise rubber for example.

The operation of the media cutting apparatus 10 is described in the following paragraphs with reference to FIGS. 1, 3 and 4A to 4E.

At block 48, the controller 12 controls the cutter arrangement 14 (and in particular, the first cutter 30) to cut the media 20 along the whole length of the first line 34 which is perpendicular to the direction of movement 36 of the media 20.

Figure 4A:
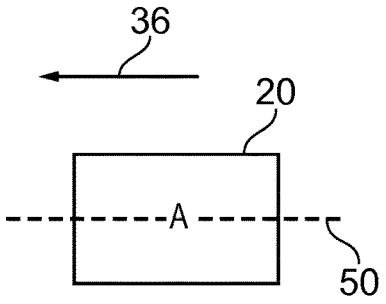
FIGS. 4A to 4E illustrate a sheet of media and how the media is cut and moved in a media cutting apparatus according to an example.

In more detail, the first cutter 30 receives the media 20 in the state illustrated in FIG. 4A. The media 20 has a first size and shape (A3 for example) and has a top surface (labelled A in the figures) and a bottom surface (labelled B in the figures). In FIG. 4A, the media 20 is arranged so the longitudinal axis 50 is oriented parallel to the direction of movement 36 of the media 20, and so that the top surface A is facing upwards.

Figure 4B:
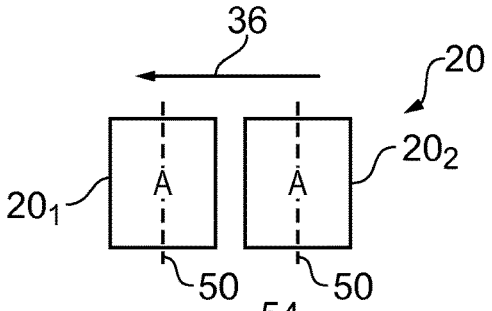

FIG. 4B illustrates the state of the media 20 after the media 20 has been cut by the first cutter 30. The media 20 has been cut into two sections $\mathbf{20}_1$ and $\mathbf{20}_2$ which have a second size and shape (A4 for example). The longitudinal axis 50 of each section $\mathbf{20}_1$ and $\mathbf{20}_2$ is oriented perpendicular to the direction of movement 36 of the media 20. The media 20 is arranged so that the top surface A of each section $\mathbf{20}_1$ and $\mathbf{20}_2$ is facing upwards.

At block 52, the controller 12 controls the first roller 16 to rotate the media 20 cut by the cutter arrangement 14 (and in particular, the first cutter 30) to change the orientation of an axis of the media 20.

In more detail, the media 20 is provided to the first roller 16 in the state illustrated in FIG. 4B. The inclination of the first roller 16 to the direction of movement 36 of the media 20 causes the first roller 16 to engage the top left corners of the first section $\mathbf{20}_1$ and the second section $\mathbf{20}_2$. Since the first roller 16 is inclined at an angle of forty five degrees to the direction of movement 36, the orientation of the first and second sections $\mathbf{20}_1$ and $\mathbf{20}_2$ is changed by ninety degrees (that is, the longitudinal axis 50 of the first and second sections $\mathbf{20}_1$ and $\mathbf{20}_2$ is rotated through ninety degrees).

Figure 4C:
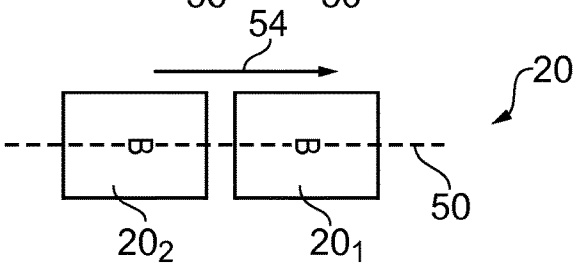

FIG. 4C illustrates the state of the media 20 after the media 20 has moved by the first roller 16. The first and second sections $\mathbf{20}_1$ and $\mathbf{20}_2$ have been re-oriented so that their longitudinal axes 50 are oriented parallel to the direction of movement 54 of the media 20 (and parallel to the axis 46 of the media cutting apparatus 10). Consequently, the first and second sections $\mathbf{20}_1$ and $\mathbf{20}_2$ have been re-oriented by ninety degrees. The first and second sections $\mathbf{20}_1$ and $\mathbf{20}_2$ have also been inverted by the first roller 16 so that their bottom surfaces B are facing upwards.

At block 56, the controller 12 controls the second roller 18 to invert the cut media 20.

In more detail, the media 20 is provided to the second roller 18 in the state illustrated in FIG. 4C. The second roller 18 engages the leading edges of the first and second sections $\mathbf{20}_1$ and $\mathbf{20}_2$ and flips them through one hundred and eighty degrees.

Figure 4D:
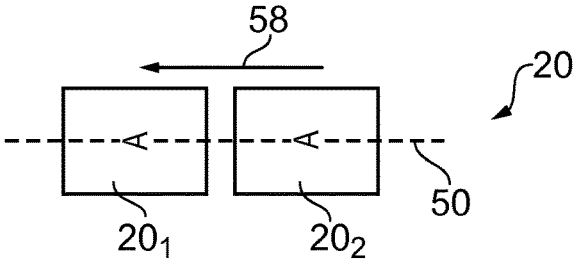

FIG. 4D illustrates the state of the media 20 after the media 20 has been moved by the second roller 18. The first and second sections $\mathbf{20}_1$ and $\mathbf{20}_2$ have been inverted so that the top surfaces A of the first and second sections $\mathbf{20}_1$ and $\mathbf{20}_2$ are facing upwards. The first and second sections $\mathbf{20}_1$ and $\mathbf{20}_2$ have also been rotated to move in a direction 58 that is parallel to the longitudinal axes 50 of the first and second sections $\mathbf{20}_1$ and $\mathbf{20}_2$ and parallel to the axis 46 of the media cutting apparatus 10.

At block 60, the controller 12 controls the cutter arrangement 14 (and in particular, the second cutter 32) to cut media 20 along the second line 38 which is perpendicular to the direction of movement 40 of the media 20.

Figure 4E:
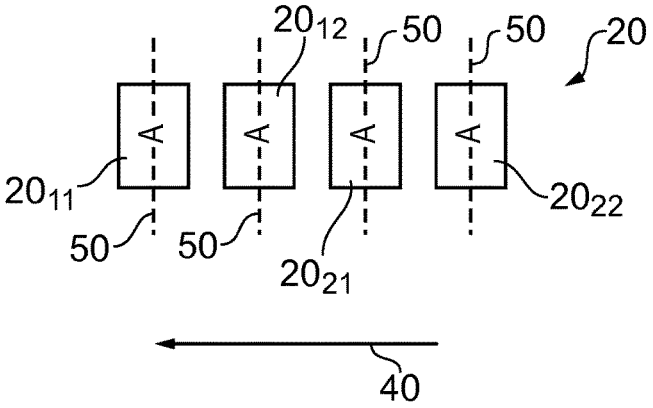

In more detail, the media 20 is provided to the second cutter 32 in the state illustrated in FIG. 4D. The second cutter 32 cuts the first and second sections $\mathbf{20}_1$ and $\mathbf{20}_2$ into first, second, third and fourth subsections $\mathbf{20}_{11}$, $\mathbf{20}_{12}$, $\mathbf{20}_{21}$ and $\mathbf{20}_{22}$ as illustrated in FIG. 4E. The subsections $\mathbf{20}_{11}$, $\mathbf{20}_{12}$, $\mathbf{20}_{21}$ and $\mathbf{20}_{22}$ have a third size and shape (A5 for example). The longitudinal axis 50 of each of the subsections $\mathbf{20}_{11}$, $\mathbf{20}_{12}$, $\mathbf{20}_{21}$ and $\mathbf{20}_{22}$ is oriented perpendicular to the direction of movement 40 of the media 20. The media 20 is arranged so that the top surface A of each subsection $\mathbf{20}_{11}$, $\mathbf{20}_{12}$, $\mathbf{20}_{21}$ and $\mathbf{20}_{22}$ is facing upwards.

The method may then include providing the subsections $\mathbf{20}_{11}$, $\mathbf{20}_{12}$, $\mathbf{20}_{21}$ and $\mathbf{20}_{22}$ as an output in a stack.

The media cutting apparatus 10 provides several advantages. One such advantage is that media is less likely to jam in the media cutting apparatus 10 than in other media cutting apparatus because the media flows continuously along the axis 46 without stopping. This may result in the media cutting apparatus 10 being more reliable than other media cutting apparatus.

The change in setup of the media cutting apparatus 10 may advantageously be controlled digitally. In particular, a user may control a user input device to select one or more settings that changes how the controller 12 controls the components (such as the first and second cutters 30, 32) of the apparatus 10. This may result in the media cutting apparatus 10 being relatively easy to reconfigure by a user of the apparatus 10.

Figure 5:
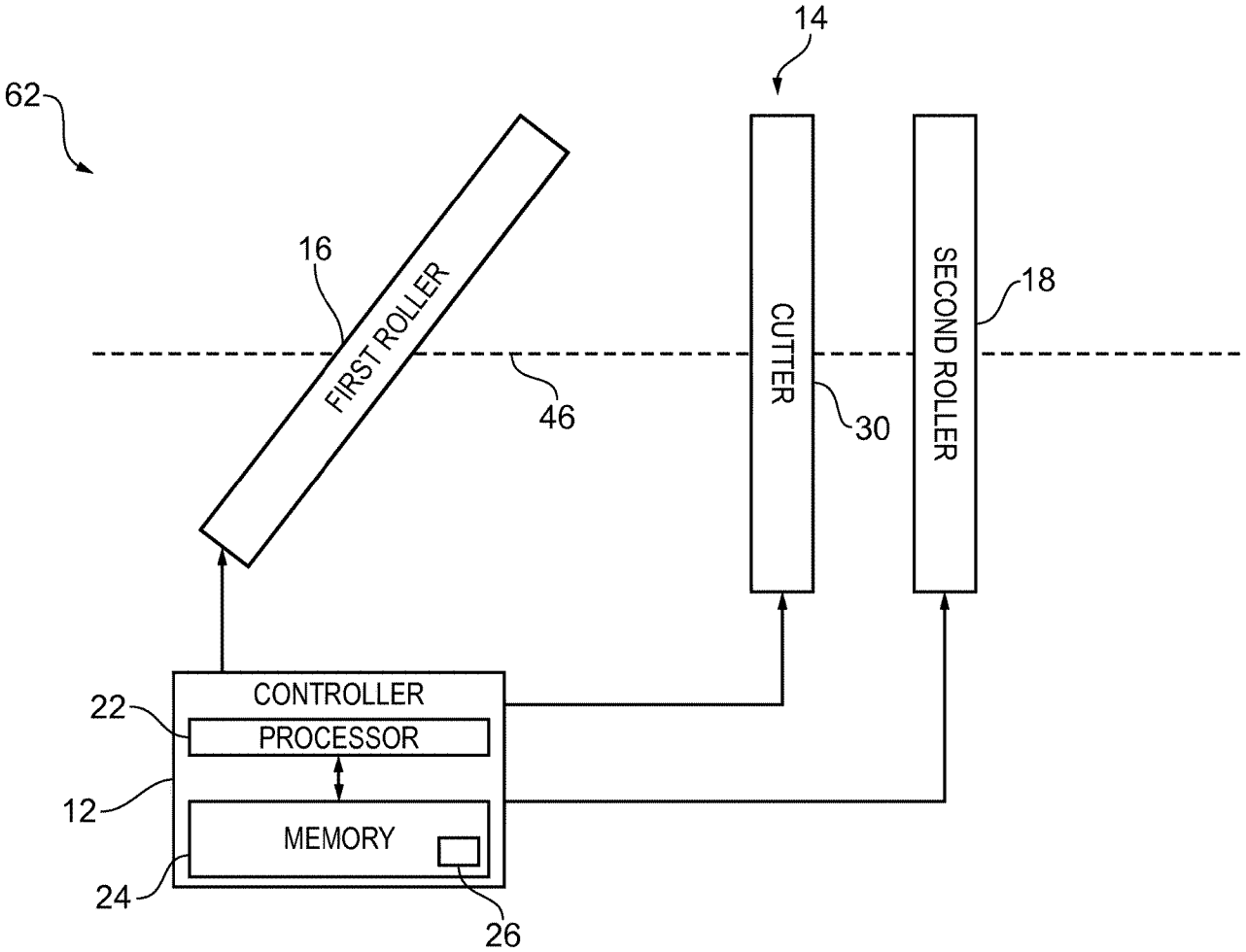
FIG. 5 illustrates a schematic plan view diagram of another media cutting apparatus according to an example.

FIG. 5 illustrates a schematic plan view of another media cutting apparatus 62 according to an example. The media cutting apparatus 62 is similar to the media cutting apparatus 10 and where the features are similar, the same reference numerals are used. The media cutting apparatus 62 differs from the media cutting apparatus 10 in that the cutter arrangement 14 includes a single cutter 30 instead of a first cutter 30 and a second cutter 32 as illustrated in FIG. 1.

In operation, the media cutting apparatus 62 is arranged so that media is fed through the cutter 30 in a first pass and cut into sections, is then re-oriented by the first roller 16, then fed through the cutter 30 in a second pass and cut into subsections, and is then inverted by the second roller 18 and subsequently output from the media cutting apparatus 62.

The media cutting apparatus 62 provides an advantage in that it may occupy less space than the media cutting apparatus 10 due to the removal of a cutter from the cutter arrangement 14. This may advantageously enable a printing company to use the additional floor space for other devices, or enable them to locate the media cutting apparatus 62 in a smaller room or premises.

Figure 6:
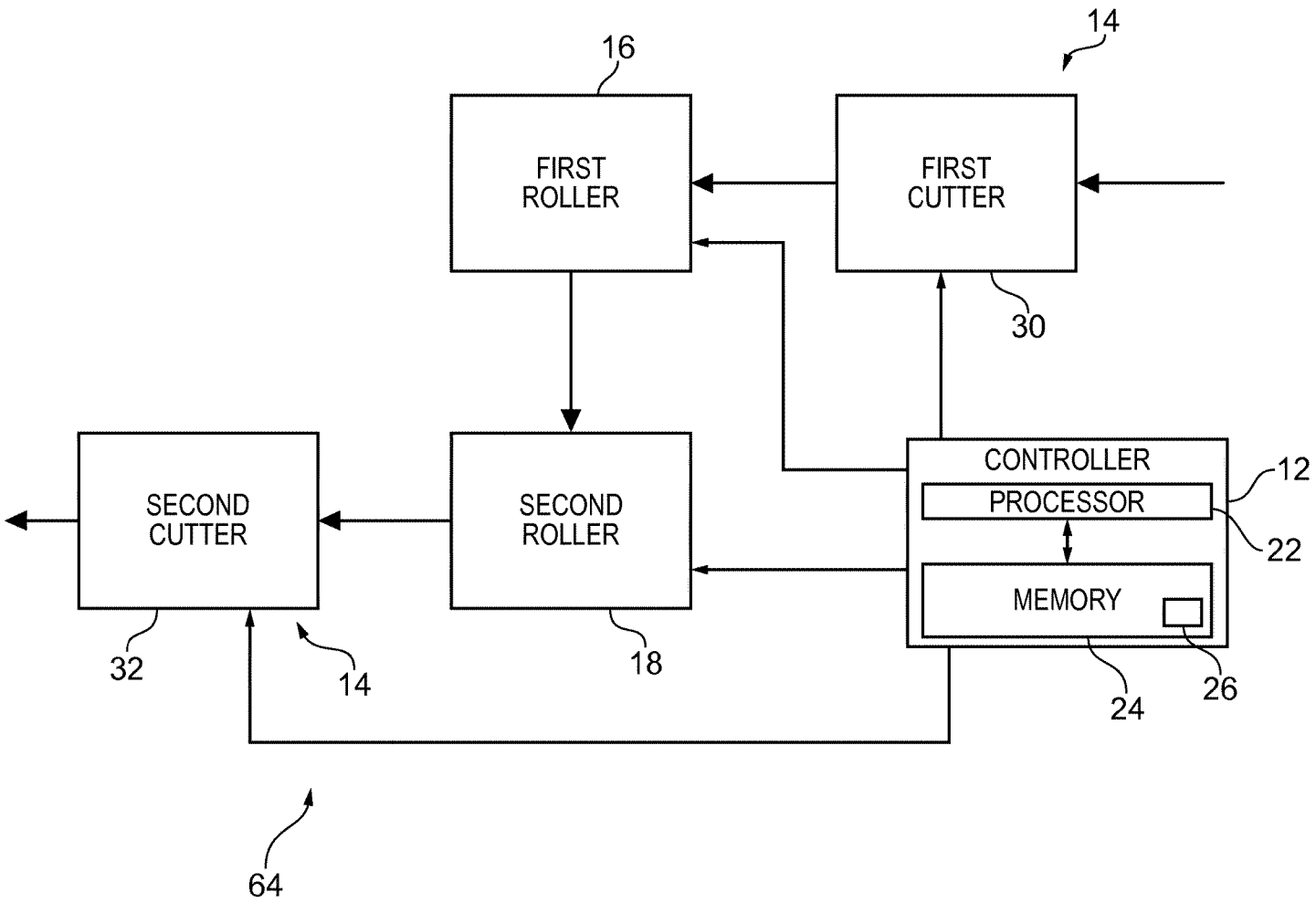
FIG. 6 illustrates a schematic side view diagram of a further media cutting apparatus according to an example.

FIG. 6 illustrates a schematic side view of another media cutting apparatus 64 according to an example. The media cutting apparatus 64 is similar to the media cutting apparatus 10 and where the features are similar, the same reference numerals are used. The media cutting apparatus 64 differs from the media cutting apparatus 10 in that the first roller 16 and the second roller 18 are positioned vertically relative to one another. In some examples, the first roller 16 may at least partially overlay the second roller 18 when viewed in plan, and in other examples, the first roller 16 may not overlay the second roller 18.

The media cutting apparatus 64 provides an advantage in that it may occupy less space than the media cutting apparatus 10 due to the vertical arrangement of the first and second rollers 16, 18. This may advantageously enable a printing company to use the additional floor space for other devices, or enable them to locate the media cutting apparatus 64 in a smaller room or premises.

In some examples, a media cutting apparatus may combine the media cutting apparatus 62 illustrated in FIG. 5 and the media cutting apparatus 64 illustrated in FIG. 6. In these examples, the media cutting apparatus includes a cutter arrangement 14 comprising a single cutter (as in apparatus 62), and the first and second rollers 16, 18 are arranged vertically relative to one another (as in apparatus 64) to reduce the floor area required by the apparatus.

Figure 7:
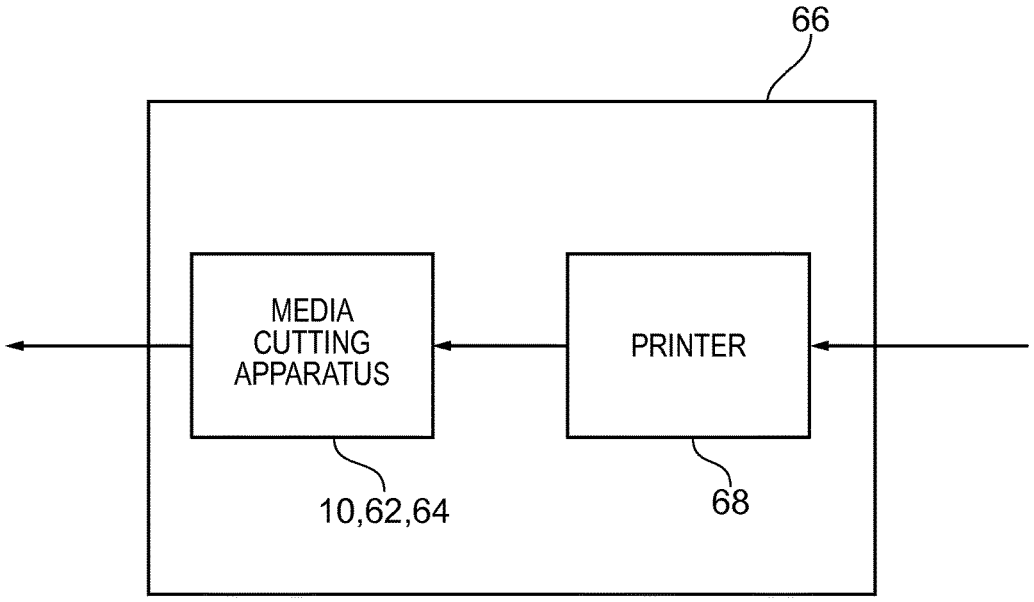
FIG. 7 illustrates a schematic diagram of a printing system according to an example.

FIG. 7 illustrates a schematic diagram of a printing system 66 according to an example. The printing system 66 includes a printer 68 and a media cutting apparatus 10, 62 or 64.

The printer 68 may be any suitable printer for printing text and/or graphics on a sheet or web of media and may be, for example, an inkjet printer or a laser printer. The printer 68 is arranged to receive a sheet or web of media (such as paper), print on the media and then provide the media to the media cutting apparatus 10, 62 or 64. The media cutting apparatus 10, 62, 64 is arranged to receive the printed media from the printer 68 and cut the media to a desired size.

In other examples, the printing system 66 is arranged so that the media cutting apparatus 10, 62 or 64 receives the media before the printer 68. In these examples, the media cutting apparatus 10, 62 or 64 first cuts the media to desired size, and the printer 68 subsequently prints on the cut media.

Figure 3:
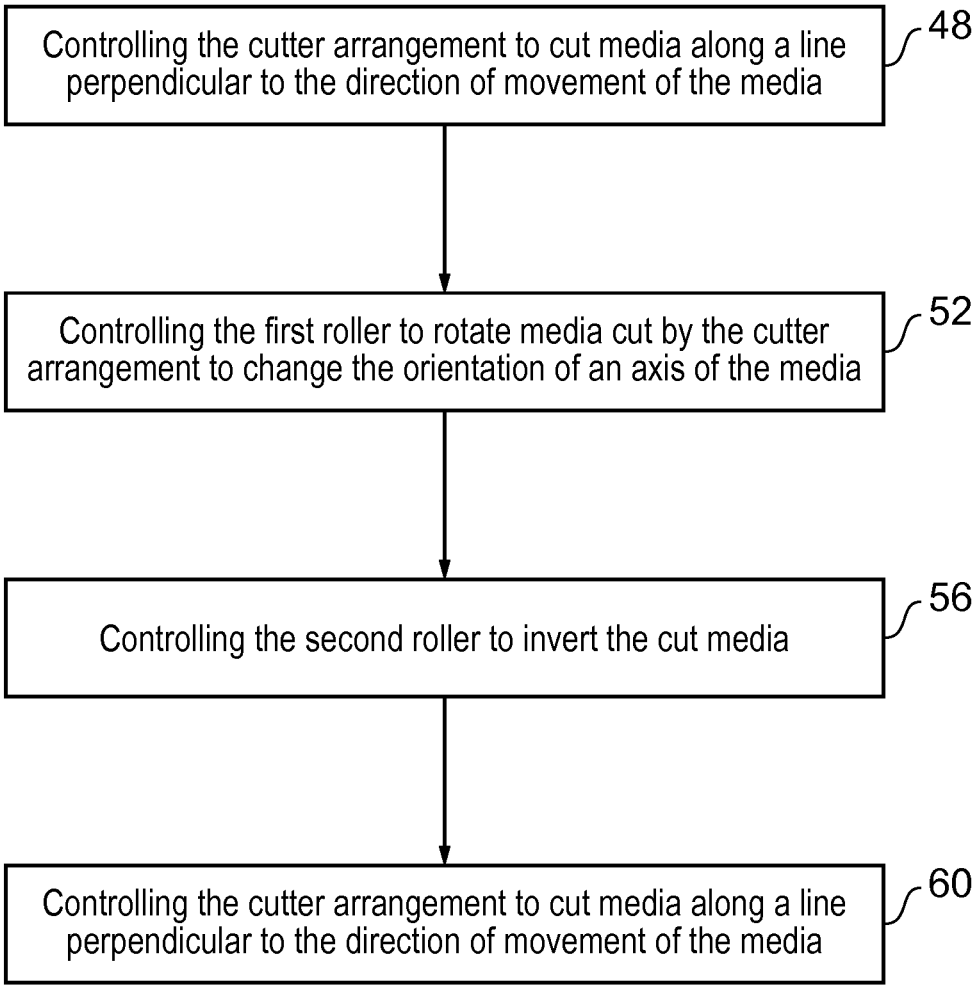
FIG. 3 illustrates a flow diagram of a method of operating a media cutting apparatus according to an example.

The blocks illustrated in the FIG. 3 may represent steps in a method and/or sections of code in the computer program 26. The illustration of a particular order to the blocks does not necessarily imply that there is a required or preferred order for the blocks and the order and arrangement of the block may be varied. Furthermore, it may be possible for some blocks to be omitted.

Although examples of the present invention have been described in the preceding paragraphs, it should be appreciated that modifications to the examples given can be made without departing from the scope of the invention as claimed. For example, the first roller 16 may not be inclined at forty five degrees to the direction of movement of the media 20 and the axis 46 of the media cutting apparatus and consequently, does not reorient the longitudinal axis of the media by ninety degrees. In such examples, the media cutting apparatus may comprise further rollers or conveyers for further reorienting the media so that the media is rotated through ninety degrees.

In the media cutting apparatus 10, 62 and 64 illustrated in FIGS. 1, 5 and 6, the media 20 is output from the left hand side of the apparatus. In other examples, the media may alternatively be output from the right hand side of the apparatus, either above or below the feed for the media.

Features described in the preceding description may be used in combinations other than the combinations explicitly described.

Although functions have been described with reference to certain features, those functions may be performable by other features whether described or not.

Although features have been described with reference to certain examples, those features may also be present in other examples whether described or not.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. Media cutting apparatus comprising:

a cutter arrangement to cut media along a line perpendicular to the direction of movement of the media, wherein the cutter arrangement comprises at least one cutter comprising:

a static blade; and a straight blade attached to, and extending at an incline along a longitudinal axis of, a rotatable roller so as to have a single point of contact with the static blade as the rotatable roller rotates;

a first roller to rotate media cut by the cutter arrangement to:

change the orientation of a longitudinal axis of the media relative to a direction of movement of the media;

invert the media a first time; and reverse the direction of movement of the media a first time; and a second roller, positioned between the first roller and a first cutter of the cutter arrangement, to rotate media cut by the cutter arrangement to:

invert the media a second time; and reverse the direction of movement of the media a second time, wherein the cutter arrangement is arranged to cut the media prior to and after rotation by the first roller.

2. Media cutting apparatus as claimed in claim 1, wherein the first roller is arranged to rotate the orientation of the longitudinal axis of the media by ninety degrees from a direction perpendicular to the direction of motion of the media to be parallel with the direction of motion of the media.

3. Media cutting apparatus as claimed in claim 1, wherein the cutter arrangement and the first roller are arranged along an axis, the media cutting apparatus being arranged to move the media continuously along the axis.

4. Media cutting apparatus as claimed in claim 1, wherein the cutter arrangement includes:

a first cutter to cut the media prior to the cut media being provided to the first roller from the first cutter; and a second cutter to cut the cut media subsequent to the cut media being rotated by the first roller.

5. Media cutting apparatus as claimed in claim 4, wherein the first cutter is arranged to cut the media along a first line perpendicular to the direction of movement of the media through the first cutter, and the second cutter is arranged to cut the media along a second line perpendicular to the direction of movement of the media through the second cutter, the first line and the second line being parallel to one another.

6. The media cutting apparatus of claim 4, wherein both the first cutter and second cutter each comprise a rotary blade and a static blade.

7. Media cutting apparatus as claimed in claim 1, wherein the cutter arrangement includes a single cutter to cut the media prior to the cut media being provided to the first roller from the single cutter, and to cut the media subsequent to the cut media being rotated by the first roller.

8. The media cutting apparatus of claim 7, wherein the media is fed through the single cutter in a first pass, re-oriented by the first roller, and fed through the single cutter in a second pass.

9. The media cutting apparatus of claim 1, wherein the first roller is inclined at an angle of forty five degrees relative to the direction of movement of the media.

10. The media cutting apparatus of claim 1, wherein the first roller is positioned between a first cutter of the cutter arrangement and a second cutter of the cutter arrangement along an axis.

11. The media cutting apparatus of claim 1, wherein the first roller engages top left corners of media cut by a first cutter of the cutter arrangement.

12. The media cutting apparatus of claim 1, wherein the first roller partially overlays the second roller.

13. The media cutting apparatus of claim 1, wherein the first roller does not overlay the second roller.

14. A printing system comprising the media cutting apparatus of claim 1.

* * * * *